US005231724A

United States Patent [19]

Haaga

[11] Patent Number: 5,231,724

[45] Date of Patent: Aug. 3, 1993

[54] SWEEPING MACHINE

[75] Inventor: Hermann Haaga, Kirchheim/Teck-Ötlingen, Fed. Rep. of Germany

[73] Assignee: Ing. Haaga Kunststofftechnik GmbH, Fed. Rep. of Germany

[21] Appl. No.: 820,778

[22] Filed: Jan. 15, 1992

[30] Foreign Application Priority Data

Jan. 23, 1991 [DE] Fed. Rep. of Germany ..... 4101888

[51] Int. Cl.[5] ..... A47L 11/32

[52] U.S. Cl. ..... 15/41.1; 15/49.1

[58] Field of Search ..... 15/41.1, 42–46, 15/49.1, 50.1, 98, 344, 87, 79.1

[56] References Cited

U.S. PATENT DOCUMENTS 4,731,895 3/1988 Zack et al. ..... 15/98

FOREIGN PATENT DOCUMENTS 0367732 5/1990 European Pat. Off. ..... 15/344
1205664 6/1966 Fed. Rep. of Germany ..... 15/50.1
2262648 1/1978 Fed. Rep. of Germany ..... 15/41.1
3605235 8/1987 Fed. Rep. of Germany ..... 15/41.1

*Primary Examiner*—Edward L. Roberts
*Attorney, Agent, or Firm*—Evenson, McKeown, Edwards & Lenahan

[57] ABSTRACT

A manually operated sweeping machine is disclosed having two circular brooms which are laterally arranged in the front area of a housing, rotate toward the inside and sweep over a sweeping lip. These circular brooms are each supported by means of a roller, the shaft holders of which are vertically adjustably held in the housing by means of supporting devices, for the adjustment of the distance between the sweeping lip and the floor. In the case of the state of the art, each supporting device is separately vertically adjustably. In addition, the shaft holders project through the housing into the supporting devices arranged on the exterior side of the housing. In the case of high axial loads on the shaft holders, these can therefore push through the supporting devices in the upward direction. According to the invention, a joint vertical-adjustment device is provided for the supporting devices.

13 Claims, 5 Drawing Sheets

SWEEPING MACHINE

BACKGROUND AND SUMMARY OF THE INVENTION

This invention relates to a sweeping machine having two circular brooms which are arranged laterally in the front area of a housing. The circular brooms rotate toward the inside and sweep over a sweeping lip and are each supported by means of a roller. The shaft holders of the rollers are held vertically adjustably in the housing by means of supporting devices for adjusting the distance between the sweeping lip and the floor.

It is known (U.S. Pat. No. 3,927,174) to drive the laterally arranged circular brooms of a sweeping machine by means of rollers arranged inside the bristle ring of the circular brooms. By means of a shaft holder arranged concentrically with respect to the circular broom, each of these rollers is vertically adjustably held in the housing. By means of the vertical adjustment of the rollers, the broom pressure on the floor can be changed, and the distance of the sweeping lip to the receptacle for the sweepings relative to the floor can be changed. The shaft holders project through the housing and are held in supporting devices which are held in the top side of the housing. Each supporting device can be vertically adjusted separately relative to the housing, whereby each shaft holder also changes its height relative to the housing.

It is an object of the invention to provide a sweeping machine of the initially mentioned type by means of which a correct adjustment of the distance of the sweeping lip from the floor and the adjustment of the broom pressure are facilitated.

This object is achieved by providing a joint vertical adjustment device for the supporting devices of both rollers.

As a result, the operating comfort of the sweeping machine is increased. By means of the measure according to the invention, it is ensured that both rollers are vertically adjusted by always the same amount so that a faulty adjustment is prevented.

As a development of the invention, the supporting devices are arranged between a stop surface of the housing and the respective, approximately vertically aligned shaft holder. As a result, the sweeping machine is considerably reinforced for the absorption of axial stresses of the shaft holders. This is particularly advantageous because it frequently happens in practice that sweeping machines are repeatedly lifted by operators during the sweeping operation and are lowered to strike the floor in order to shake out the sweepings caught in the bristles. In the state of the art, in the case of a particularly violent striking against the floor, the shaft holders might be stressed in the axial direction to such an extent that they were pressed upward through the supporting elements and destroyed these. This is prevented by the mentioned development.

In a further development of the invention, each supporting device is constructed as a slide which can be adjusted transversely to the pertaining shaft holder and has a sloped supporting surface facing the end of the shaft holder. The slides with the oblique supporting surfaces form the axial abutment for the shaft holders so that, by means of a displacement of the slides, the axial position of the shaft holder can be adjusted.

In a further development of the invention, a joint adjusting element for the adjusting of the slides is provided. In a further development, an adjusting wheel which is rotatably disposed on the housing is provided as the adjusting element. By means of a simple rotating of the adjusting wheel, the height of the two shaft holders and thus of the two rollers relative to the housing can be adjusted in each case by the same amounts.

In a further development of the invention, the adjusting wheel is provided with two stops for the bounding of its adjusting range which are arranged at an angle with respect to one another. An overturning of the adjusting wheel and resulting damage to the vertical adjustment device are therefore avoided.

In a further development of the invention, several lock-in positions are provided on the housing in the area of the adjusting wheel distributed over the adjusting range into which the adjusting wheel can be locked. As a result, the adjusting wheel can be locked in certain given adjusting positions.

Other objects, advantages and novel features of the present invention will become apparent from the following detailed description of the invention when considered in conjunction with the accompanying drawings.

DETAILED DESCRIPTION OF THE DRAWINGS

Figure 1:
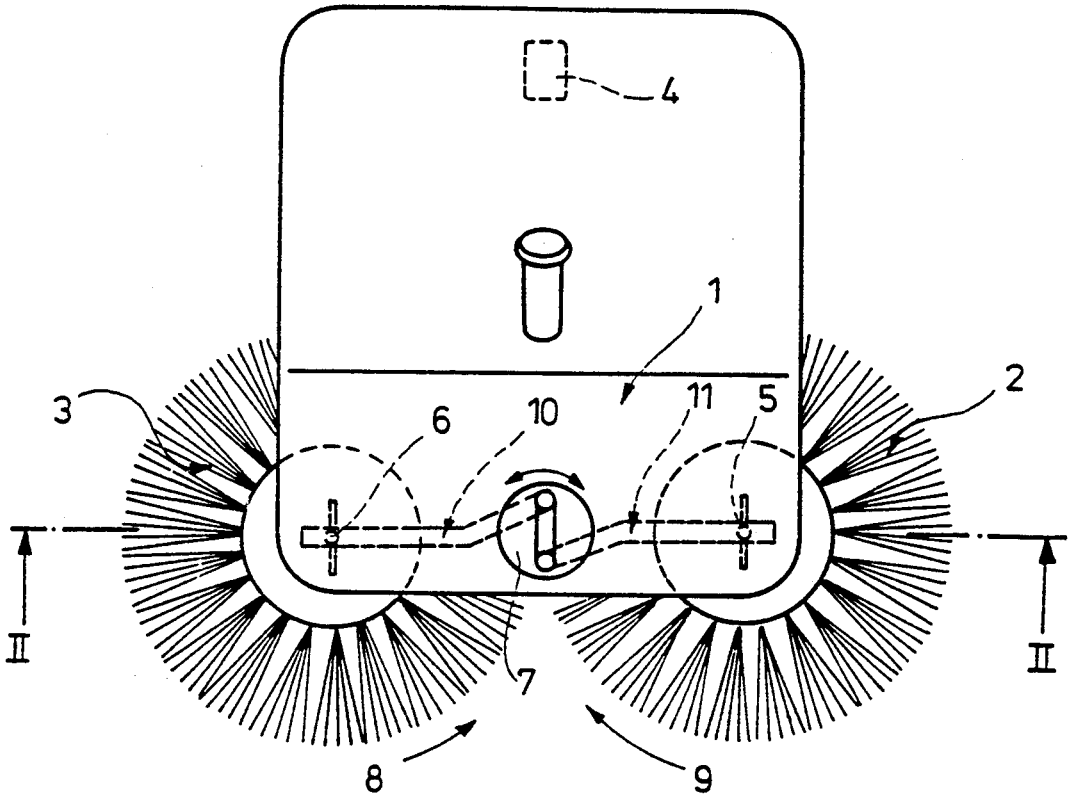
FIG. 1 is a schematic representation of a top view of an embodiment of the sweeping machine according to the invention, in which rollers for the drive of the circular brooms are arranged inside their bristle ring, and the shaft holders of these rollers, by means of two slides which can be actuated by an adjusting wheel, can be adjusted jointly in their height relative to the housing of the sweeping machine.

A sweeping machine according to FIG. 1 has two circular brooms 2, 3 which are arranged laterally on the front of the housing 1, rotate toward the inside in the direction of the arrows 8, 9, and sweep the sweepings onto a shovel-type receiving device, a so-called sweeping lip, in the area of the housing bottom. The sweeping lip is arranged on a receiving plate provided behind the sweeping area of the two circular brooms 2, 3 which is part of the housing bottom. The circular brooms 2, 3 are driven by one roller respectively running on the floor which, in the case of the embodiment shown, is arranged inside the bristle ring of each circular broom 2, 3. The circular brooms 2, 3 are rotatably disposed on the housing 1. Their axes of rotation, in this case, are sloped such with respect to the perpendicular line that their bristles sweep essentially over the area of the floor in front of the sweeping lip. In the rear part of the housing 1 of the sweeping machine, a runner 4 is provided on its underside. With respect to the drive and the construction, the sweeping machine according to FIG. 1 corresponds essentially to a sweeping machine which is described in detail in German Patent Document DE-PS 22 62 648, which corresponds to U.S. Pat. No. 3,937,174, as well as in German Patent Document DE-OS 36 05 235. Particularly, the drive of the circular brooms 2, 3 carrying the rollers in the steering and trailing rollers as well as the shape and construction of the receiving plate carrying the sweeping lip are described there in detail and will not be explained here any further.

Each roller is held in the housing 1 of the sweeping machine by means of a shaft holder 5, 6 which is concentric with respect to one circular broom 2, 3 respectively. The shaft holders 5, 6 are rotatably and axially movably disposed in radial bearings. In order to be able to adjust the distance of the sweeping lip to the floor as well as the broom pressure of the circular brooms 2, 3 to the floor, particularly for receiving different sweepings, the height of the shaft holders 5, 6 and thus that of the rollers relative to the housing 1 can be adjusted. The change of the broom pressure onto the floor by means of a vertical adjustment of the shaft holders 5, 6 is obtained by the fact that the circular brooms 2, 3 themselves cannot be changed in their height relative to the housing 1.

The sweeping machine according to FIG. 1 is provided with a joint height adjustment device for the simultaneous changing of the height of both shaft holders 5, 6 relative to the housing 1 by the same amounts respectively. The height adjustment device comprises an adjusting wheel 7 which is rotatably disposed in the top side of the housing I and, on the bottom side of which, which penetrates through the top side of the housing, two slides 10, 11 are pivotally connected which extend in the inside of the housing 1 on both sides of the sweeping machine to the shaft holders 5, 6 and are applied to the ends of the shaft holders 5, 6 in a manner that will be explained below. All parts of the height adjusting device, which will still be described, are manufactured according to the plastic injection molding method at 10 cost with respect to aspects of manufacturing technology.

Figure 2:
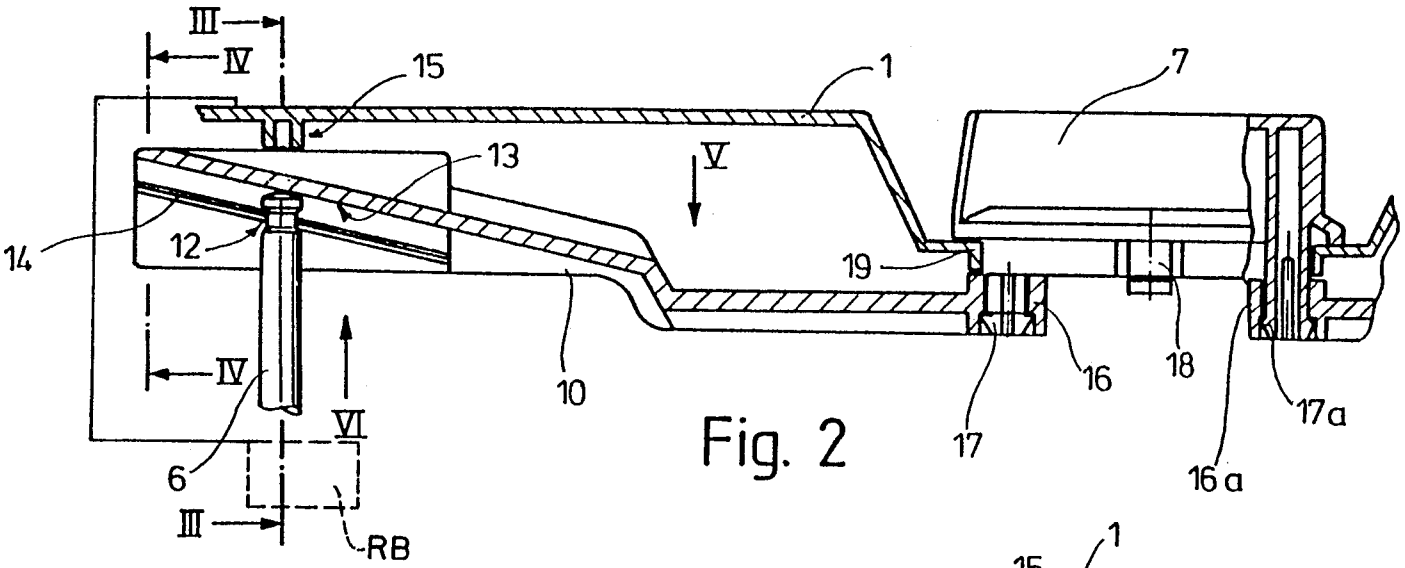
FIG. 2 is an enlarged representation of a sectional view along Line II—II of FIG. 1, which in the manner of a cutout shows the vertical-adjustment device of a shaft holder which can be vertically adjusted relative to the housing on a sloped supporting surface of a slide that can be displaced by rotating of the adjusting wheel, in which case, for a simplified representation, the adjusting wheel is rotated by 90° with respect to the position according to FIG. 1.
Figure 7:
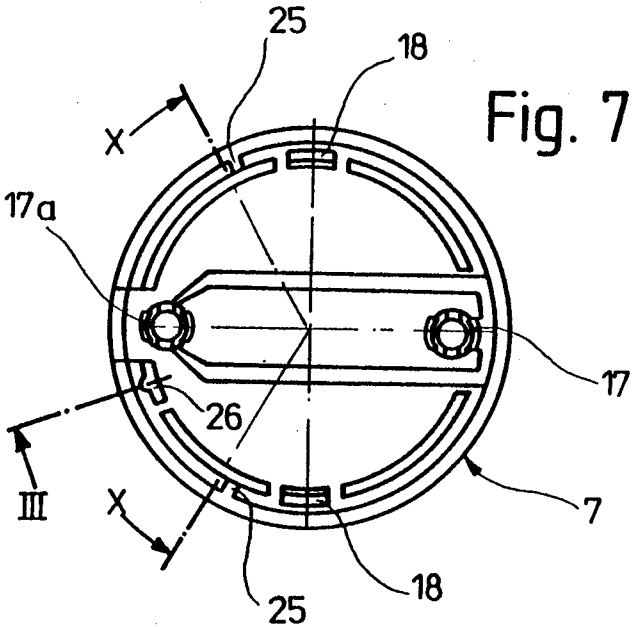
FIG. 7 is a view of the adjusting wheel according to FIG. 2 from below, in which case the adjusting wheel is constructed as a plastic injection-molded part and can be mounted by a simple snapping-together because of corresponding undercuts and locking hooks.

FIG. 2 shows that the adjusting wheel 7 is arranged in an indentation of the top side of the housing 1 and is inserted into an opening of the housing 1. The opening in the housing 1 is circular and is bounded by an edge 19 of the housing wall. It is only for reasons of drawing techniques that the adjusting wheel 7 in FIG. 2 is turned into a position which it actually cannot take up since its adjusting range is limited, as will be explained below. The adjusting wheel 7 has a grip 27 (FIG. 9) by means of which it can be turned by an operator. The interior side of the adjusting wheel 7 is hollow in order to permit a simple ejection from the mold during the manufacturing, as indicated in FIG. 7. The outside diameter of the adjusting wheel 7 is larger than the diameter of the opening bounded by the border 19. This outside diameter is determined by a ring collar which rests above the border 19 on the top side of the housing 1. Four circular-arc-shaped ribs, which are distributed along the circumference of the adjusting wheel 7, project through the opening to the interior of the housing 1 in the downward direction and define a hollow-cylindrical area. This hollow-cylindrical area is slightly smaller than the diameter of the opening of the housing 1 so that the adjusting wheel 7 can be rotated with play inside the opening. The distance from the bottom side of the ring collar of the adjusting wheel to the bottom edge of the circular-arc-shaped ribs corresponds to the height of the border 19. Between two adjacent ribs, brackets 18 provided with detents projecting toward the outside are arranged opposite one another on the adjusting wheel 7 which also point downward from the bottom side of the adjusting wheel 7. The two detents of the two brackets 18 are also joined to the brackets 18 at a distance below the ring collar of the adjusting wheel 7 which corresponds to the height of the border 19. As a result, the detents reach behind the lower edge of the border 19 so that the adjusting wheel 7 is axially fixed in the housing 1. The adjusting wheel 7 can therefore be mounted in the opening by a simple snapping-in.

Two pins 17 and 17*a* extend downward from the bottom of the grip of the adjusting wheel 7, have an essentially hollow-cylindrical shape and are disposed opposite one another at the largest possible distance. The two pins 17 and 17*a* also project through the opening of the housing 1 and downward beyond the circular-arc-shaped ribs. The two pins 17 and 17*a* are slotted on their ends and are provided with detents projecting toward the outside. As a result, the pins are elastically deformable in this area. The adjusting wheel 7 is manufactured as a plastic injection molded part and, because of its described construction, can be ejected relatively easily from the mold during the manufacturing.

Figure 5:
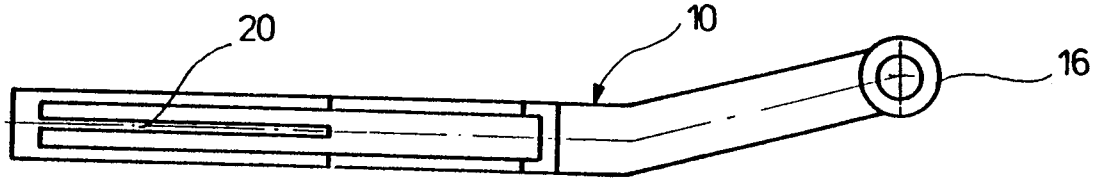
FIG. 5 is a top view of the slide in the direction of the arrow V according to FIG. 2 in which it is shown that the slide is buckled in order to transmit the rotating movement of the adjusting wheel into an almost linear sliding movement.

One slide respectively 10, 11 is snapped onto each pin 17, 17*a*. The two slides 10, 11 have the same construction so that only one slide 10 is shown in detail in FIG. 2. The ring-shaped end 16 (FIG. 5) which is snapped onto the pin 17 is provided with a stepped opening, the diameter of which is adapted to the diameter of the pin or that of the detents of the pin 17. The height of the ring-shaped end 16 corresponds to the length by which the pin 17 projects beyond the bottom edge of the border 19. As a result, the ring-shaped end 16 of the slide 10 in its mounted position is fixed axially toward the top and toward the bottom. The slide 10 essentially has a rod shape and is buckled in its horizontal plane (FIG. 5) and bent at right angles in its vertical course (FIG. 2). The buckling of the slide 10 in the horizontal plane, as will become clear below, is used for translating the rotating movement of the adjusting wheel 7 as well as possible into a linear sliding movement and to minimize the swivel movements of the slide 10. The bending at right angles in the vertical direction is expedient because the adjusting wheel 7 and particularly the pin 17 are situated relative to the housing 1 below the ends of the shaft holders 5, 6. Because of the bending at right angles, it is possible to carry out a horizontal sliding movement above the end of the shaft holder 6 although the pin 17 is situated below this end 12. The slide 10 is a profile which starts on the ring-shaped end 16 with a U-shaped cross-section, and then, starting from the right-angle bend, changes into an approximately H-shaped cross-section. The crossbar 13 of the approximately H-shaped section forms the supporting surface for the crowned end of the shaft holder 6 and extends with a slope of approximately 12° with respect to the horizontal line. On the webs of the profile which point downward, guide ribs 14 are molded on which extend in parallel to the crossbar 13 and project into a ring groove 12 of the shaft holder. The crossbar 13 and the guide ribs 14 form a type of connecting-link guide for the shaft holder which is inserted into this connecting-link guide from the direction of the open end. For the purpose of reinforcement, an additional center rib 20 is provided between the upwardly projecting lateral webs. The lateral webs and the center rib end in a common horizontal plane and rest on a stop 15 molded onto the upper wall of the housing which forms a horizontal stop face.

Figure 3:
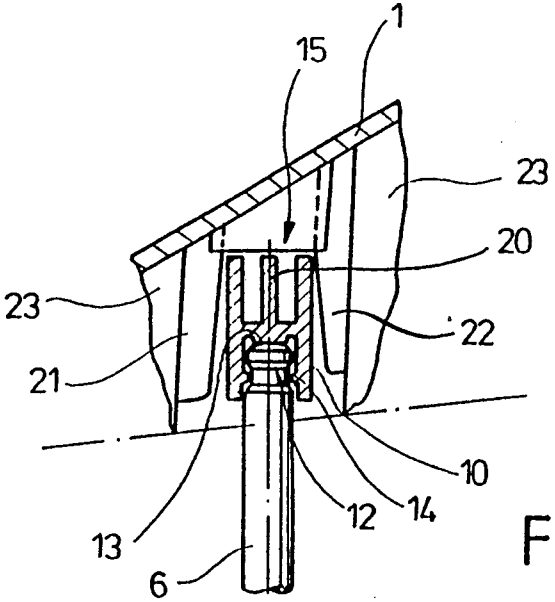
FIG. 3 is a further enlarged representation of a sectional view along Line III—III in FIG. 2 which is a sectional view of the arrangement of the slide and the shaft holder in the area of the stop face of the housing.
Figure 4:
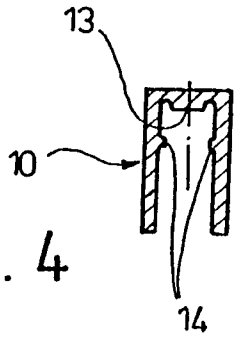
FIG. 4 is a sectional view of the profile of the slide along Line IV—IV of FIG. 2.
Figure 6:
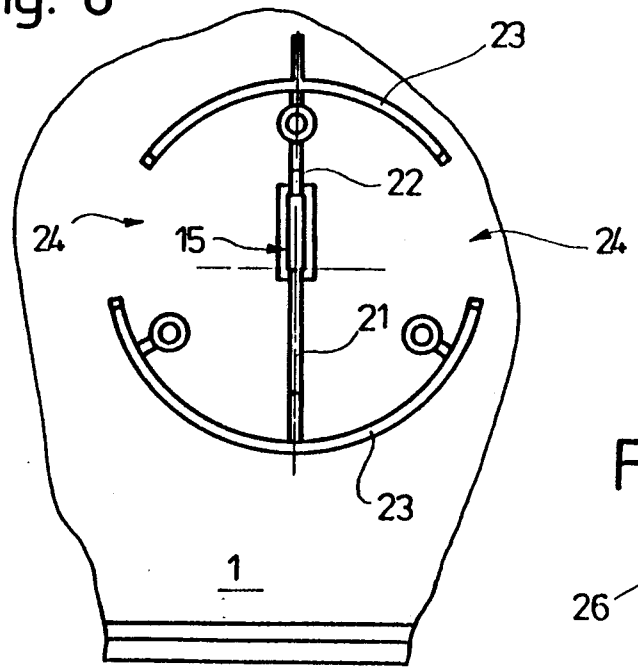
FIG. 6 is a cutout of a view of the bottom side of the housing in the direction of the arrow VI of FIG. 2, in which case here, in contrast to the simplified representation of FIG. 2, the profile of the supporting surface is shown in detail including the injection-molded-on reinforcements for the fastening of the radial bearing of the shaft holder.

FIGS. 3 and 6 illustrate that on both sides of the stop 15. transversely to the sliding direction of the slide, which is not shown, two narrow rib-type guides 21 and 22 are arranged which are slightly sloped toward the outside with respect to the perpendicular line starting from the stop face. The guides 21 and 22 receive the slide 10 between one another, in which case the outer walls of the lateral webs of the slide 10 have punctiform or, at most, linear contacts with the guides 21 and 22. The radial bearing for the shaft holder 6, which is not shown, is fastened to bearing flanges 23 by means of three screwed connections (FIG. 6). The bearing flanges 23 are circular-arc-shaped and, in the sliding area of the slide 10, have slots 24 which are large enough in order to also not interfere with the occurring swivel movements of the slide 10. The radial bearing leaves play with respect to the slide 10 in the axial direction. As soon as the sweeping machine is lifted, for example, the slide 10 is pulled downward as a result of the inherent weight of the shaft holder 6 including its roller. The guides 21 and 22, which extend diagonally with respect to the stop face 15, are also used for ensuring a perfect contact of the profile of the slide 10 on the stop 15 when the sweeping machine is put down again.

By rotating the adjusting wheel 7, a pushing or pulling movement is exercised on the slides 10, whereby these are caused to slide along at the end of the respective shaft holder 5, 6. In the case of a maximal sliding path of the slide 10, the shaft holder 6 is vertically adjustable by approximately 10 to 12 mm. The slope of the crossbar 13 is dimensioned such that the vertical-adjustment device is selflocking because of the supporting load of the shaft holder 6 and is not automatically adjusted by the constant pressure of the shaft holder 6.

Figure 8:
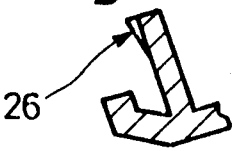
FIG. 8 is an enlarged cutout of a sectional view along line VIII in FIG. 7 of a detent of the adjusting wheel which ca be locked in different locking positions of the housing
Figure 9:
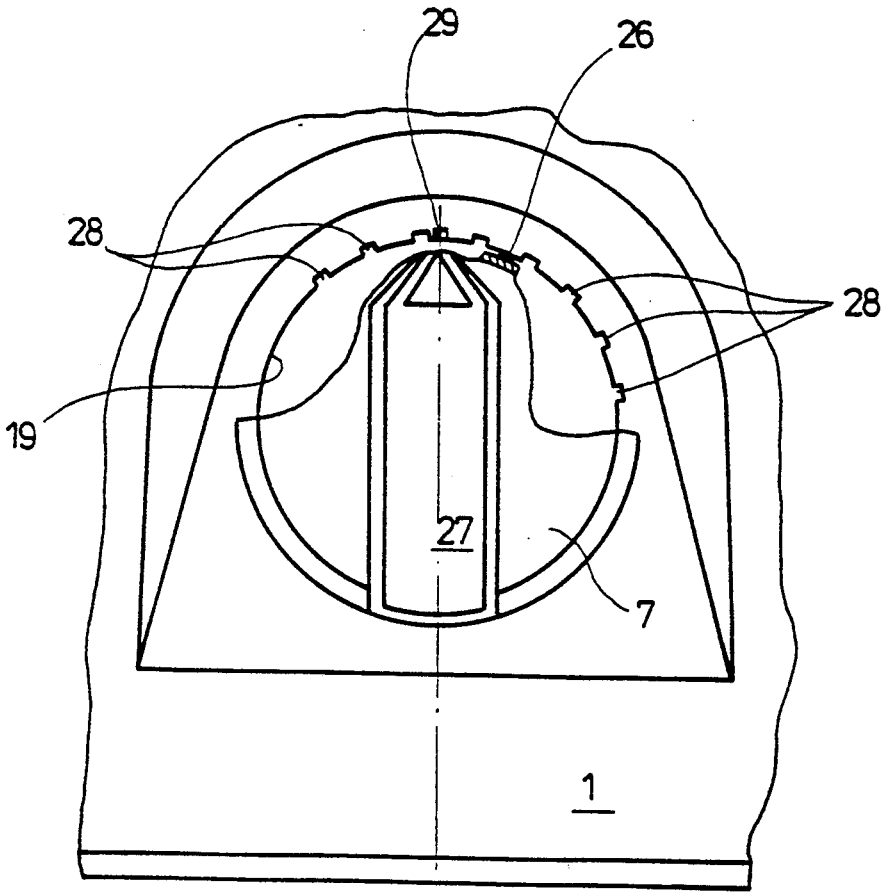
FIG. 9 is a cutout of a top view of the housing top part in the area of the opening for the adjusting wheel, in which the locking recesses for the detent according to FIG. 8 are shown which are arranged at a distance from one another.

As shown particularly in FIGS. 7 and 9, the adjusting angle (X) for the adjusting wheel is limited to approximately 120°. This takes place by two stops 25 on the bottom side of the adjusting wheel 7 situated opposite one another at a corresponding angle which interact with a corresponding stop 29 on the top side of the housing 1 in the area of the opening for the adjusting wheel 7. For this reason, the adjusting wheel 7 can be rotated, from the direction of the longitudinal center axis of the sweeping machine, toward both sides by approximately 60°. In the embodiment shown, this adjusting range is subdivided into eight adjusting positions which are constructed as eight locking recesses 28 in the border 19 of the opening for the adjusting wheel 7, as shown in FIG. 9. A detent 26 of the adjusting wheel 7 locks into these locking recesses 28 which is shown in FIGS. 7 and 8 as well as, as a cutout, in FIG. 9. This detent 26 is molded to an elastically resilient bracket which is arranged on the circular line of the brackets 18 and is situated so far below the ring collar of the adjusting wheel 7 that it can engage in the locking recesses of the border 19. For reasons concerning manufacturing methods, the detent 26 is arranged offset with respect to the longitudinal center axis of the adjusting wheel 7 so that the locking recesses 28 are also arranged offset to the longitudinal center axis in order to permit a symmetrical adjustment of the grip 27 of the adjusting wheel 7 in the top side of the housing.

Figure 10:
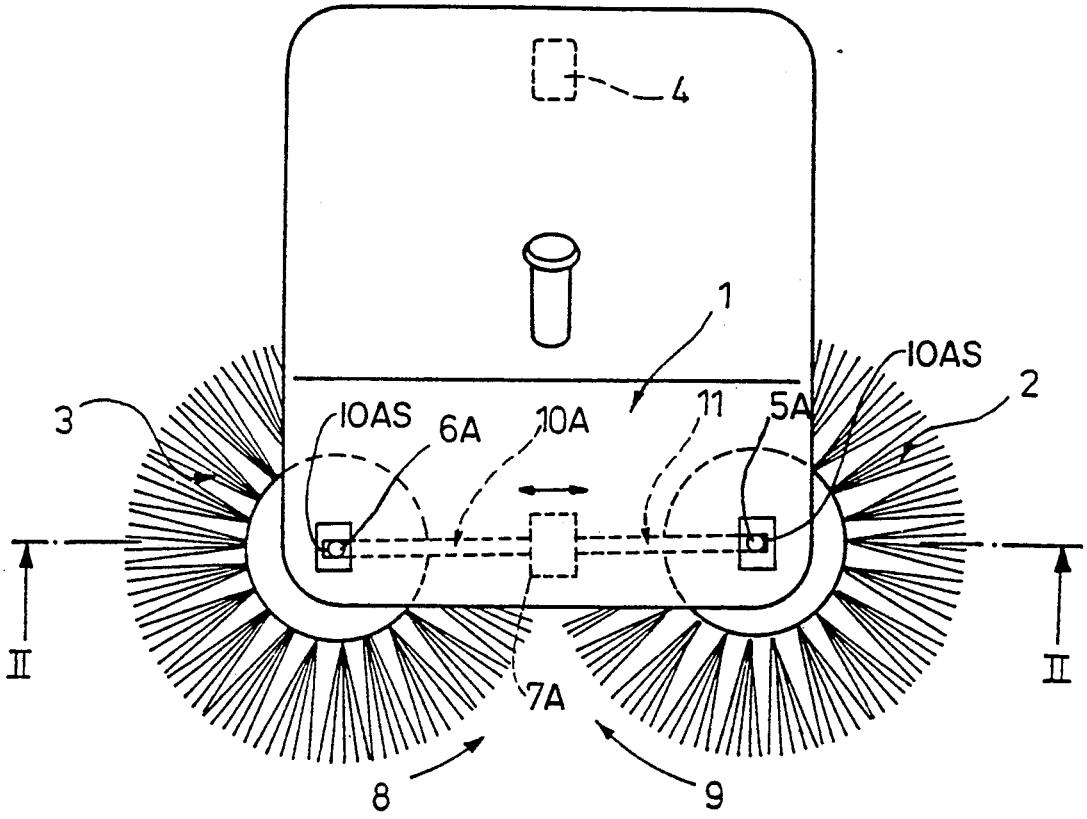
FIG. 10 is a schematic representation similar to FIG. 1, showing an alternative embodiment with an axially movable single slide for adjusting the relative height of the shaft holders.

In another embodiment of the invention, schematically depicted in FIG. 10 instead of the two slides 10 and 11, a joint slide 10A is provided which is equipped with one sloped supporting surface 10AS respectively for the ends of the shaft holders 5 and 6. This joint slide can be adjusted by means of an adjusting button 7A in that, in a simple manner, the adjusting button is pushed in a straight line in one or the other direction and as a result transmits a linear pushing movement to the slide.

In another embodiment of the invention, the shaft holders, including their rollers, are not situated inside but, for example, behind the circular brooms 2, 3 in the driving direction. This does not change the basic construction of the vertical-adjustment device.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A sweeping machine comprising: a housing, a pair of circular brooms arranged laterally in a front area of the housing, said circular brooms being rotatable toward one another to sweep over a sweeping lip, a pair of support rollers for operatively engaging respective ones of the brooms via means interposed between each broom and roller pair and for supporting respective ones of the circular brooms, each support roller being connected to the housing by a shaft holder, and supporting apparatus for supporting the shaft holders with vertical adjustability of the shaft holders with respect to the housing, wherein said supporting apparatus includes a common vertical adjustment device provided for both shaft holders.

2. A sweeping machine according to claim 1, wherein the housing includes a stop, and wherein the supporting apparatus includes respective support devices arranged between the stop of the housing and a respective one of the shaft holders.

3. A sweeping machine according to claim 2, wherein each support apparatus is constructed as a slide which can be adjusted transversely with respect to the respective shaft holder and which has a sloped supporting surface facing the end of the respective shaft holder.

4. A sweeping machine according to claim 3, wherein each slide has guides at a distance below the sloped supporting surface and in parallel to it, said guides serving to guide respective ends of the shaft holder.

5. A sweeping machine according to claim 2, wherein the support apparatus of both rollers are arranged on a common slide which can be adjusted transversely with respect to the shaft holders and which is provided with an adjusting element which is movable in a straight line relative to the housing.

6. A sweeping machine according to claim 1, wherein each support apparatus is constructed as a slide which can be adjusted transversely with respect to the respective shaft holder and which has a sloped supporting surface facing the end of the respective shaft holder.

7. A sweeping machine according to claim 6, wherein each slide, has guides at a distance below the sloped supporting surface and in parallel to it, said guides serving to guide respective ends of the shaft holder.

8. A sweeping machine according to claim 7, wherein a common adjusting element is provided for the adjusting of the slides.

9. A sweeping machine according to claim 6, wherein a common adjusting element is provided for the adjusting of the slides.

10. A sweeping machine according to claim 9, wherein an adjusting wheel is provided as the adjusting element, said adjusting wheel being rotatably bearingly supported on the housing.

11. A sweeping machine according to claim 6, wherein the adjusting wheel is provided with two stops for limiting its adjusting range, said stops being arranged at an angle with respect to one another.

12. A sweeping machine according to claim 11, wherein several lock-in positions are provided distributed along the adjusting range in the area of the adjusting wheel on the housing, into which lock-in position the adjusting wheel can be locked.

13. A sweeping machine according to claim 1, wherein the support devices of both rollers are arranged on a common slide which can be adjusted transversely with respect to the shaft holders and which is provided with an adjusting element which is movable in a straight line relative to the housing.

* * * * *